United States Patent [19]

Saloff et al.

[11] Patent Number: 4,643,481

[45] Date of Patent: Feb. 17, 1987

[54] SEAT SYSTEM FOR PREVENTING DECUBITI

[76] Inventors: William S. Saloff, Heather La., R.M., Gloversville, N.Y. 12078; David Saloff, 91 Hillside Ave., Mount Kisco, N.Y. 10549

[21] Appl. No.: 669,550

[22] Filed: Nov. 8, 1984

[51] Int. Cl.[4] ..... A47C 7/02

[52] U.S. Cl. ..... 297/458; 5/436; 297/DIG. 1; 297/DIG. 2; 297/DIG. 4

[58] Field of Search ..... 297/DIG. 4, DIG. 1, 297/458, 218, DIG. 2; D6/596; 5/436, 455

[56] References Cited

U.S. PATENT DOCUMENTS

| | | | |
|---|---|---|---|
| D. 169,366 | 4/1953 | Feldman | D6/596 |
| 2,260,437 | 10/1941 | Chambers | 5/436 |
| 3,008,153 | 11/1961 | Coulter | 5/436 X |
| 3,177,036 | 4/1965 | Halter | 297/454 |
| 3,376,070 | 4/1968 | Johnson | 5/436 X |
| 3,611,455 | 10/1971 | Gottfried | 5/348 |
| 3,630,572 | 12/1971 | Homier | 297/DIG. 2 |
| 3,749,442 | 7/1973 | Berg et al. | 297/312 |
| 3,896,891 | 7/1975 | Miltenberg | 297/DIG. 4 |
| 4,132,228 | 1/1979 | Green | 128/33 |
| 4,445,240 | 5/1984 | Voorhees | 5/455 X |

FOREIGN PATENT DOCUMENTS

| | | | |
|---|---|---|---|
| 0041037 | 11/1981 | European Pat. Off. | 297/DIG. 4 |
| 83/03195 | 9/1983 | PCT Int'l Appl. . | |

*Primary Examiner*—James T. McCall

*Attorney, Agent, or Firm*—Heslin & Rothenberg

[57] ABSTRACT

A seat system comprised of a base and cushion. The base has a specially contoured support surface including a forward section and a rearward section. The rearward section has a pair of wings surrounding a void over which the user's ischia and coccyx are to be positioned. The void is mushroomed in its cross-sectional shape because the rearmost portion of the wings contain enlargements for providing support to the buttock at the rear. A sloped forward support surface rises forwardly of the void and tapers into a single ridge which continues forwardly to separate a pair of troughs. This forward support surface, together with the wings and rear support surfaces form a "bucket" or bowl-shaped portion of the total seating surface for proper positioning of the ischia and coccyx over the void. The cushion has a peripheral shape matching that of the base, including a void which is mushroomed in cross-sectional shape. Means are provided for securing the cushion to the base with the void of each in approximate registration. The wings of the cushion may be secured in a plurality of positions relatively closer to or further away from one another, thus providing a precise adjustment to the needs of a particular user.

14 Claims, 8 Drawing Figures

SEAT SYSTEM FOR PREVENTING DECUBITI

BACKGROUND AND SUMMARY OF THE INVENTION

This invention relates to seat systems and, more particularly, to systems intended to provide long term seating with minimal formation of decubitous sores, and other physiological disorders which occur as a result of long term seating such as nerve, muscle and skeletal disorders.

The problem of preventing the formation of decubitous sores is particularly difficult in patients who are required to sit for long times, especially in wheelchairs. In this position, a person's weight is greatly concentrated in the buttock area and there is a natural tendency for decubiti to form in the tissue under the ischial bones and the coccyx. One has only to consult the trade literature to realize that numerous attempts have been made to solve this problem. There are a great many different seat systems reflecting these efforts and various degrees of success have been achieved.

One fundamental approach taken by many who have attacked this problem is to relieve the pressure under the seat bones and redistribute it to the surrounding areas of the buttock and thighs. That too is the fundamental approach taken with the subject invention. Most if not all, prior attempts to solve this problem have employed the philosophy that at least some pressure can be tolerated under the seat bones. The philosophy of the subject invention, however, is to eliminate that pressure virtually in its entirety, but without producing unacceptably high pressures elsewhere. In fact, as will be mentioned later, the subject invention results in essentially zero pressure under the ischial bones and the coccyx while pressure readings at surrounding areas of the buttock are sufficiently low to permit adequate blood circulation in the capillaries contained therein, even in the trochanteric area. This invention thus results in an achievement not found in prior art devices.

SUMMARY OF THE INVENTION

It is, therefore, an object of this invention to provide a seat system in which pressure under the seat bones is virtually eliminated.

It is a further object of this invention to provide a seat system of the type described in which pressures experienced by the buttock and thighs are sufficiently low to permit adequate blood circulation in the capillaries contained therein.

It is a further object of this invention to provide a seat system of the type described which can serve as the structural seat element in a collapsible wheelchair.

It is a further object of the invention to provide a seating support system of the type described which will provide the optimum in postural support and stability thereby addressing orthopedic concerns, e.g., lower back fatigue as well as the unimpeded message carrying responsibility of the nerves in the buttocks region and under the thighs.

These and other objects of the invention are achieved in a unique system employing a specially shaped and contoured base which supports a cushion having a substantially similar peripheral shape. The base has a forward section and a rearward section. The rearward section is characterized by having a pair of wings which define a void which is mushroomed in its cross-sectional shape and over which the ischial bones and the coccyx are intended to be positioned. The void has a relatively larger head portion located in the central interior of the rearward section and extending far enough laterally on both sides to accommodate the ischial bones and a relatively smaller stem portion extending rearwardly from the head portion to accommodate the coccyx. Proper alignment of the user over the void is accomplished by means of a generally oval and bowl-shaped support surface for the buttock partially surrounding the void. A forward support surface which slopes and spreads rearwardly and downwardly to the void forms a forward part of the bowl-shaped support surface. A pair of troughs run forwardly on either side of the forward support surface and into the forward section of the base where they continue forwardly on either side of a central ridge. These troughs serve to support the user's thighs in an abducted position. The cushion is secured to the base by means which permit its wings to be selectively positioned in a plurality of positions relatively closer to or further away from one another in order to precisely adjust the configuration of the seat system to the anatomy of a particular user.

DETAILED DESCRIPTION OF THE DRAWINGS

Figure 1:
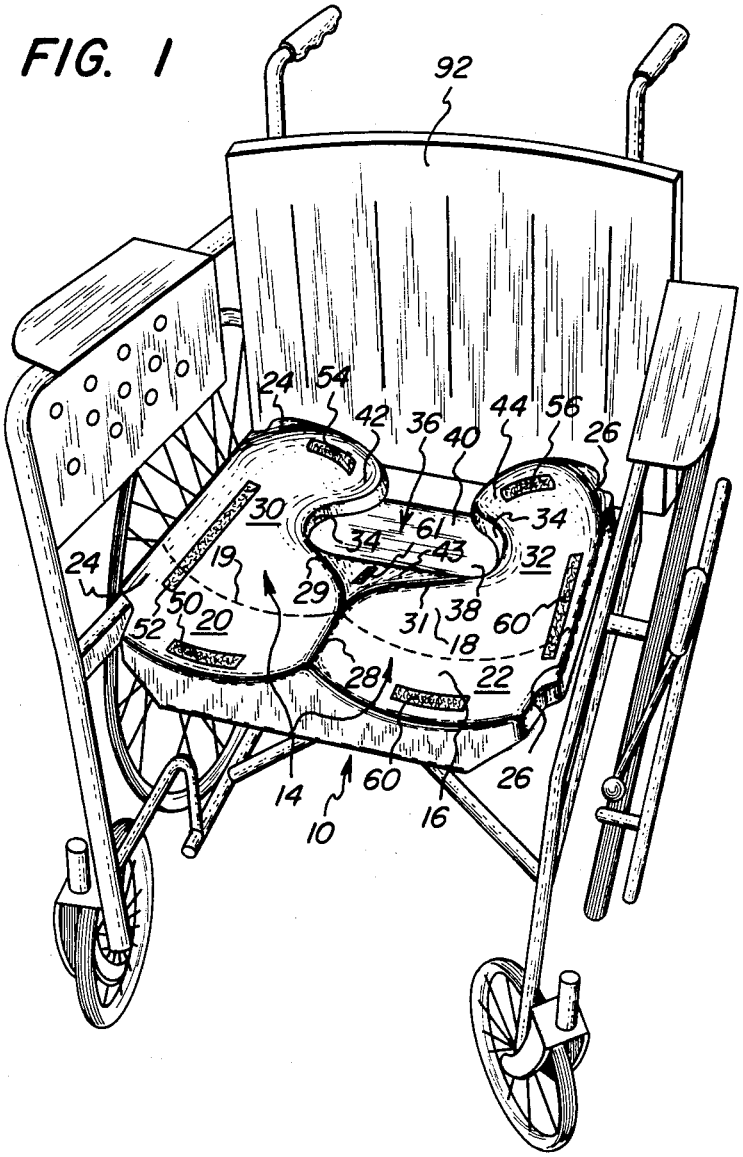
FIG. 1 is a perspective view showing the base portion of the seat system placed in a wheelchair.
Figure 2:
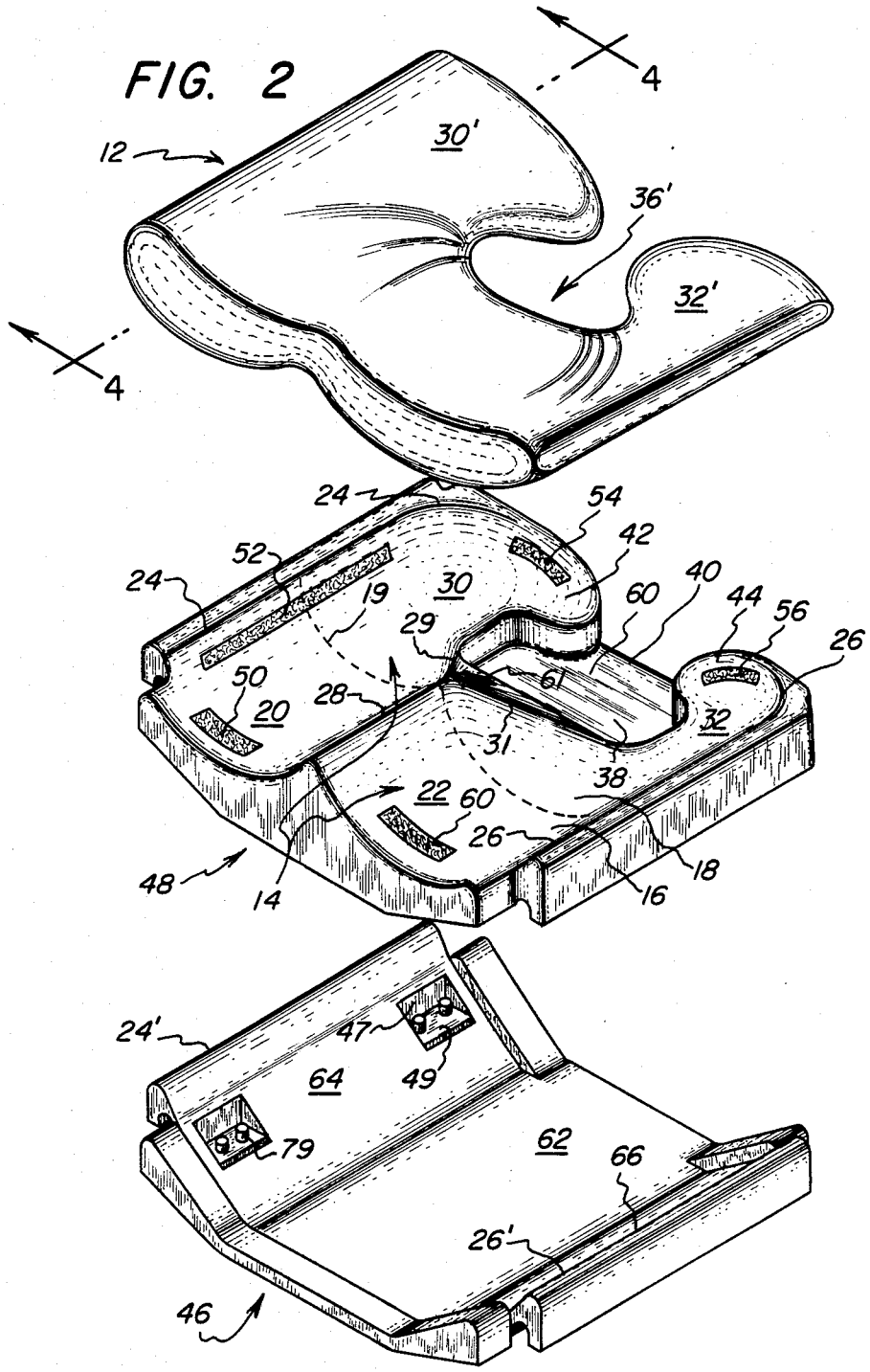
FIG. 2 is an exploded view showing the base in two parts and the cushion of this invention.
Figure 3:
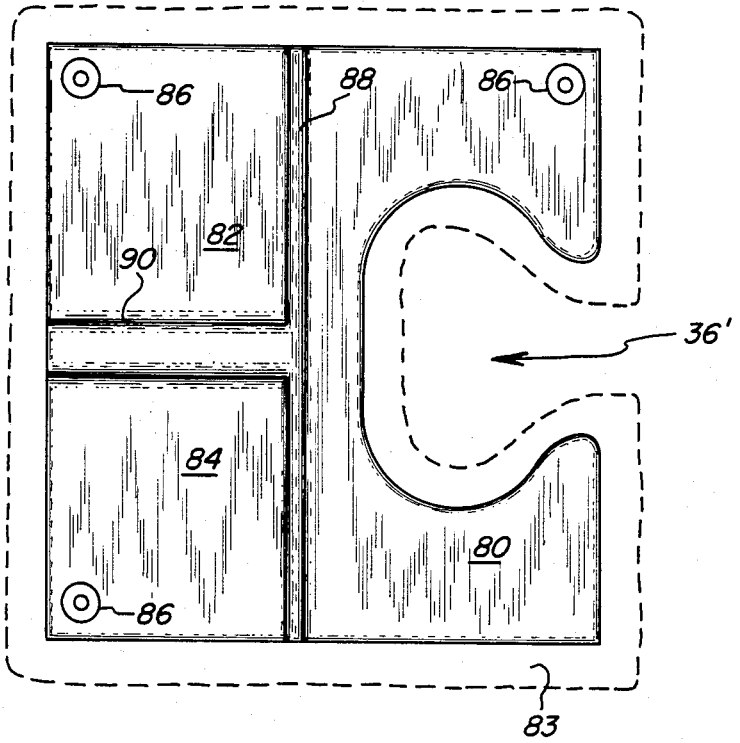
FIG. 3 is a top plan view showing the organization of the flotation cells of the cushion of the invention.
Figure 4:
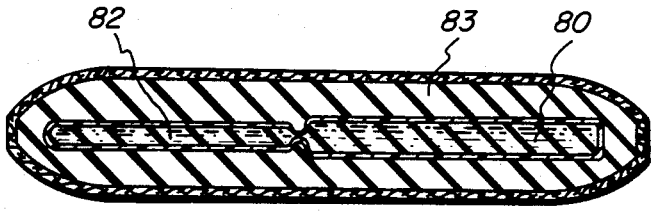
FIG. 4 is a cross-sectional view of the cushion taken along line 4—4 of FIG. 2.
Figure 5:
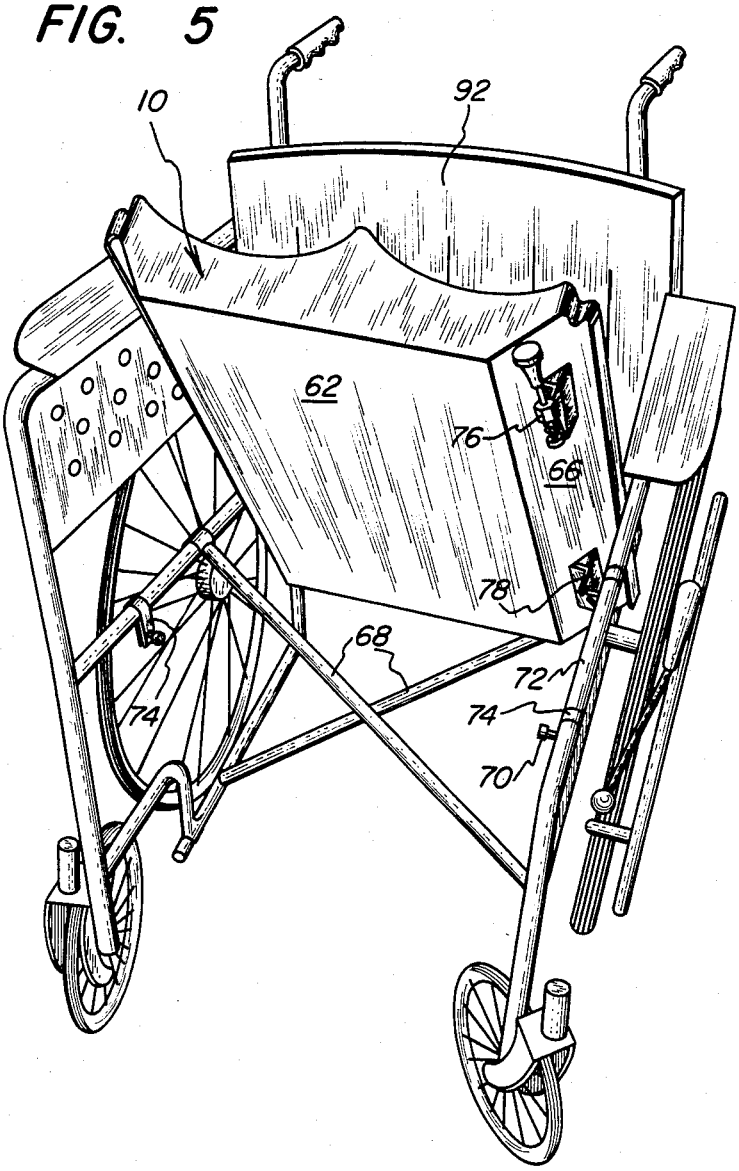
FIG. 5 is a perspective view showing the manner in which the base of the invention is secured to a conventional wheelchair.

The seating system of this invention includes a rigid base 10, as shown in FIGS. 1 and 5 and a cushion 12, as shown in FIGS. 2, 3 and 4. In normal use, cushion 12 is secured to base 10. In one of its applications, the seating system of this invention, including base 10 and cushion 12, may be installed in a wheelchair and FIGS. 1 and 5 show one way in which that may be done.

Base 10, as shown in FIGS. 1 and 2, has a contoured seating surface 14 which is comprised of two sections, a forward section 16 and a rearward section 18 divided for convenience in this description by an imaginary line 19 which runs laterally across the base at the rear end of a ridge 28 to be described below. "Forward" or "front" in this context means that section or end of the base 10 or cushion 12 which is intended to support the legs of one using the seating system. "Rearward" or "rear" refers to that section or end of the seating system intended to support the buttock, typically near a backrest. The forward section 16 of seating surface 14 includes that portion of base 10 having a pair of contoured troughs 20 and 22 for supporting one's legs. These troughs are located between a pair of rounded side edges 24 and 26 and a rounded central ridge 28. Note that side edges 24 and 26 continue along the sides of rearward section 18 and curve partially around the rear of base 10. As shown, the surfaces of troughs 20 and 22 are curved in order to provide maximum contact and support for a user's legs.

Rearward section 18 is a continuation of forward section 16 in that there is no sharp division or surface relief feature between them. Forward section 16 simply flows smoothly into rearward section 18. Imaginary line 19 is drawn through the rearward end of central ridge 28 where it becomes split into two rearward diverging ridges 29 and 31. All of these ridges are rounded at their peaks as are all edges of seating surface 14. Rearward section 18 includes a pair of wings 30 and 32 which form part of seating surface 14. Wings 30 and 32 are formed as surfaces sloping inwardly and downwardly toward one another from side edges 24 and 26, respectively, much in the same way that troughs 20 and 22 do. However, the surfaces of wings 30 and 32 terminate in an inner rounded edge 34 which defines a void 36 which is mushroomed in its horizontal cross-section shape. Void 36 has an enlarged head portion 38 measuring typically six to eight inches in width between wings 30 and 32 and which is located interiorly and centrally of the rearward section 18 and a stem portion 40 measuring typically three to four inches in width and which runs rearwardly from head portion 38 centrally through the rearward section 18. The purpose of void 36 is to minimize direct contact between the seat system and the user in the vicinity of the ischia and coccyx. No portion of seating surface 14 is intended to provide any support directly under those seat bones. Rather, the purpose of void 36 is to totally eliminate the pressure on those bones which results in systems of the type which provide support under them. This, of course, is a key element which helps to greatly retard, if not totally prevent, the formation of decubitous sores. Also important in this respect are rear support member 42 and 44. These are enlarged portions of wings 30 and 32, respectively, and they protrude inwardly from the wings toward one another. As such, they form the outline of stem portion 40 of void 36. The function of rear support members 42 and 44 is to provide support to the user at the rear of his buttock, but without making contact directly under the coccyx. This support is critical in giving the user a sense of balance and in further distributing the pressure away from the seat bones. Without rear support members 42 and 44, the user's buttock would simply be urged rearwardly in the seat system and the rearmost portion of his buttock would be relatively unsupported. Also, too much support would then be concentrated in the more forward and lateral parts of seating surface 14 creating too much pressure under the user's legs and against the sides of his buttocks. Rear support members 42 and 44, in cooperation with void 36, thus serve to achieve the most complete diffusion of pressure possible to the surrounding anatomy without creating any significant pressure in the highly decubitousprone areas under the ischia and the coccyx. Also, rear support members 42 and 44 promote a more correct sitting posture which causes the user's spine to be more erect.

The overall shape of the rear section 18 around void 36 is concave. This is due to the downward sloping of the wings 30 and 32 from side edges 24 and 26 along the sides of base 10 and around the rear where those edges curve inwardly toward one another. It should also be noted that there is a cooperative relationship between rear support members 42 and 44 and central support member 43. Central support member 43 slopes downwardly and spreads from the rear end of central ridge 28 between diverging ridges 29 and 31 until it terminates along inner rounded edge 34. It thus serves to counteract the tendency to slide downwardly and forwardly created by the rear support members 42 and 44. The wings 30 and 32 with rear support members 42 and 44 and central support member 43 cooperate to form a partial bowl for the buttock around void 36. Troughs 20 and 22 flow smoothly into that bowl. In fact, the outermost halves of troughs 20 and 22, those being the halves of each nearest side edges 24 and 26 form a smooth continuous surface running from the front of base 10 rearwardly in an axially straight manner and they simply continue that way through rearward section 18 as wings 30 and 32 until they reach the point where each side edge 24 and 26 begins to curve inwardly toward the other. This point occurs where head portion 38 of void 36 begins to taper into stem portion 40. At that point, each wing becomes curved along an axis substantially concentric with the lines of curvature of top edges 24 and 26. Obviously, the degree of curvature, as well as the distance between wings 30 and 32, are chosen to accommodate the size of the intended user. Once again, the purpose of the concavity or bowl shape of rear section 18 and the selection of these dimensions is to provide maximum contact with the user by approximating the anatomical shape of the buttock. Of course, the bowl shape tends to be oval rather than round because the lateral distance between side edges 24 and 26 before they curve inwardly must be sufficient to accommodate the user's trochanters and is typically about 41 cm. while the rearward distance running centrally from the rear end of central ridge 28 to the rear end of base 10 is typically only about 24 cm. Dimensions such as these give the bowl shape sufficient depth to provide lateral support on the sides of the buttock, including the trochanteric areas and the sides of the upper legs. In short, the wings 30 and 32 with rear support members 42 and 44 and central support member 43 form a bucket type seat which accurately positions the seat bones over void 36.

In practice, base 10 may be molded in a variety of sizes in order to approximately fit each user. As will be more fully appreciated hereinafter, cushion 12 can be used in combination with base 10 to more precisely fit the seating system of this invention to the anatomy of an individual user. Base 10 may be constructed of plastic or any other material having adequate strength which can be fabricated in the shapes just described. It has been found to be convenient, as shown in FIG. 2, to mold base 10 in two parts, a bottom member 46 and a top member 48, which can be cemented together after installation of any fixtures which may be desired. For example, it may be desired to install fixtures for attachment of base 10 to a wheelchair as will be described below.

A satisfactory working prototype of this invention employs a bottom member 46 and a top member 48, each of which is a continuous sheet of molded plastic having a width from side to side of about 41 cm., a length from front to rear of about 44.5 cm. and a nominal thickness of about 0.2 cm. and formed with the shapes described herein and depicted in FIG. 2. These parts were formed in a vacuum molding process and the shape of the back side of each, not visible in FIG. 2, follows the shape shown and described herein so as to be the negative thereof. Top member 48 nests in bottom member 46. This is accomplished primarily with the use of the rounded side edges 24 and 26 of top member 48 which fit over rounded side edges 24' and 26' of bottom member 46. It should be understood that void 36 terminates in a flat bottom plate 60 which is molded as an integral part of top member 48. When top member 48 and bottom member 46 are nested, plate 60 rests against a central portion of bottom member 46 to provide adequate structural rigidity. The height of side edges 24 and 26 above plate 60 is about 7.5 cm. and the depth of void 36 from inner edge 34 to the surface of plate 60 is about 2.5 cm. The length of void 36 from front to rear along its centerline is about 16 cm. and the transition of void 36 from head portion 38 to stem portion 40 occurs gradually, beginning a few cms. before the midpoint of that length and ending a few cms. after the midpoint.

It may be seen in FIGS. 2 and 5 that bottom member 46 is formed with three panel sections, a central panel 62 and side panels 64 and 66. This construction is particularly convenient because it permits sufficient clearance to accommodate the cross bars 68 typically found in conventional wheelchair structures. Consequently, the user can sit at normal wheelchair height, thereby avoiding difficulty in getting his legs under a table of normal height or under the steering wheel of an automotive vehicle which has been customized to accommodate drivers sitting in conventional wheelchairs or in transferring himself from a wheelchair to a bed or another seating surface. This is generally not true with seat systems which are simply placed on the sling of a wheelchair.

Figure 6:
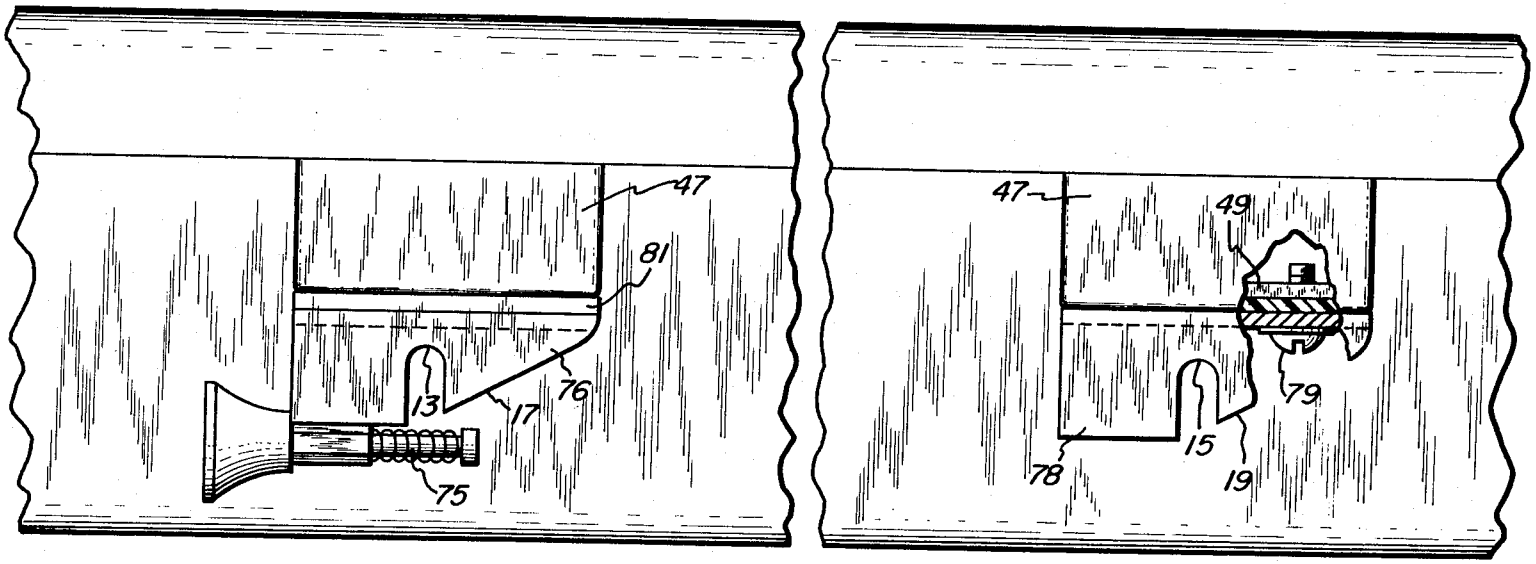
FIG. 6 is a side elevation of bottom member 46 of FIG. 2 in fragmentary form.

FIG. 5 also illustrates the manner in which the seat system may be secured to a conventional collapsible wheelchair with its sling removed without sacrificing collapsibility. Four headed studs 70 are attached to the horizontal bars 72 of the wheelchair by means of brackets 74. Hardward fixtures 76 and 78 are attached to the underside of base 10 to interact with studs 70. FIGS. 2 and 6 illustrate one manner in which fixtures 76 and 78 may be anchored to base 10. Lower member 46 is formed with recesses 47. Within each recess 47 on the inside of member 46, a tapped metal plate 49 can be riveted or cemented to member 46. Then fixtures 76 and 78 can be secured to the outside by means of machine bolts 79. Each fixture 76 and 78 has a groove, 13 and 15, respectively, to receive the shank portion of it associated stud 70. Once base 10 is properly in place, the headed portion of each stud 70 will be located on the inside of its associated bracket 76 or 78. Since the head is larger in size than the grooves 13 and 15, the wheelchair cannot spread. Each fixture 76 has a spring-biased locking plunger 75 which serves to prevent the front end of base 10 from being accidentally lifted off the front studs 70. Plungers 75 are, of course, pulled forwardly during installation or removal of base 10 to or from a wheelchair in order to open grooves 13. The sloped edges 17 and 19 on fixtures 76 and 78 assist in locating studs 70 in grooves 13 and 15. As shown in FIG. 5, installation can be accomplished by first placing rear fixtures 78 on their associated studs and then lowering base 10 onto the front studs 70.

The structures just described for attaching the base 10 to a wheelchair have the important advantage that they permit the forward or rearward adjustment of base 10 with respect to the backrest 92 of the wheelchair. This is accomplished simply by loosening, proper positioning and retightening of brackets 74. This adjustment is critical if the user is to receive proper support with the subject seating system. If the seating system is too far forward, then the user will tend to slide downward and forward on wings 30 and 32, thereby losing the support from those wings, particularly rear support members 42 and 44. If the seat is too far rearward, then the user likewise cannot receive the buttock support intended to be provided by members 42 and 44. Since the anatomy of one user differs from that of another, the ability to shift base 10 forwardly and rearwardly is necessary in order to provide the necessary individual adjustments.

Another important adjustment afforded by the structures described above concerns the tilt of base 10. This adjustment can be provided by placing one or more shims 81 (see FIG. 6) under the fixtures used to attach base 10 to studs 70. Certain users can be benefited by raising base 10 on one side and not the other. Others can be benefited by raising the rear and not the front. Again, the individual anatomies of the users are involved and this becomes a matter of individual adjustment.

As shown in FIG. 2, cushion 12 has the same overall peripheral size and shape as that of base 10, including a void 36'. In normal use, cushion 12 is aligned with base 10 so that its void 36' is generally in registration with void 36 of base 10. The attachment of cushion 12 to base 10 is accomplished by means of a series of VELCRO fastening strips, their loop portions 50, 52, 54, 56, 58, 60 and 61 being cemented at strategic locations in base 10, as shown in FIGS. 1 and 2 and their hook portion being similarly located on the underside of cushion 12. One important advantage of using such an attachment device is that it permits wings 30' and 32' of cushion 12 to be adjusted toward or away from one another. This is another key element of the invention because it permits one to make fine adjustments to precisely fit the seating system to the anatomy of a particular user. This is important because, as a practical matter, base 10 would ordinarily be fabricated in a limited number of sizes. Thus, there will be very few cases in which the precise spread and contour of wings 30 and 32 in base 10 will precisely match the anatomy of the user. Thus, the adjustment of wings 30' and 32' permits one to make the best possible fit with a user. It also provides a user with the possibility of reshaping the cushion slightly from time to time to compensate for any permanent compression due to wear or just for the sake of discovering a more comfortable position. Thus, a VELCRO type fastening system is most convenient, but any other suitable system would work as well.

FIGS. 3 and 4 illustrate the interior construction of cushion 12. FIG. 3 shows that cushion 12 is comprised of three flotation cells including a rear cell 80 and two forward cells 82 and 84. Each flotation cell has its own valve 86 and does not communicate with the others. The rear cell 80 is separated from the two forward cells 82 and 84 by a seam 88. Seam 88 runs laterally across cushion 12 from side to side. Forward cells 82 and 84 are separated from one another by a seam 90 which runs centrally from a point on seam 88 forwardly. Seam 90 is located for registration with ridge 28 of base 10 (see FIGS. 1 and 2) and is generally wide enough to accommodate the width of ridge 28. The purpose of the foregoing arrangement is to ensure stable and comfortable support for the user. The isolation of rear cell 80 from the two forward cells is important because the rear cell is generally required to support more weight than the forward cells. If rear cell 80 were not isolated from forward cells 82 and 84, too much fluid would migrate to the forward cells, causing the user to "bottom out". The use of a single rear cell 80, moreover, permits the user to shift his position while retaining a comfortable feeling. The fluid within rear cell 80 will simply shift from one side to the other as this occurs, but will always retain a sufficient depth to prevent bottoming out, assuming a cell envelope with sufficiently low elasticity is used. From FIG. 4, it may be noted that the forward cells are somewhat thinner than the rear cell. This construction is generally possible because the forward cells are required to support less weight and it represents another possible way in which to adjust the tilt of the seating system of this invention.

Cells 80, 82 and 84 may be of the conventional flotation type using an elastomeric material for an envelope and having an internal cellular material to damp the movement of fluid from one portion of the cell to another. For the details of one suitable cell construction the reader is referred to U.S. Pat. No. 4,370,768, the contents of which are hereby incorporated by reference. However, any other equivalent and suitable flotation cell could be used. Cushion 12 is constructed with a layer of resilient foam material 83 around cells 80, 82 and 84 and is preferably enclosed with an outer covering of a suitable waterproof and breathable fabric which may be periodically removed for laundering. The fabric should be sufficiently supple so as not to interfere with the user's immersion into the flotation cells.

Figure 7:
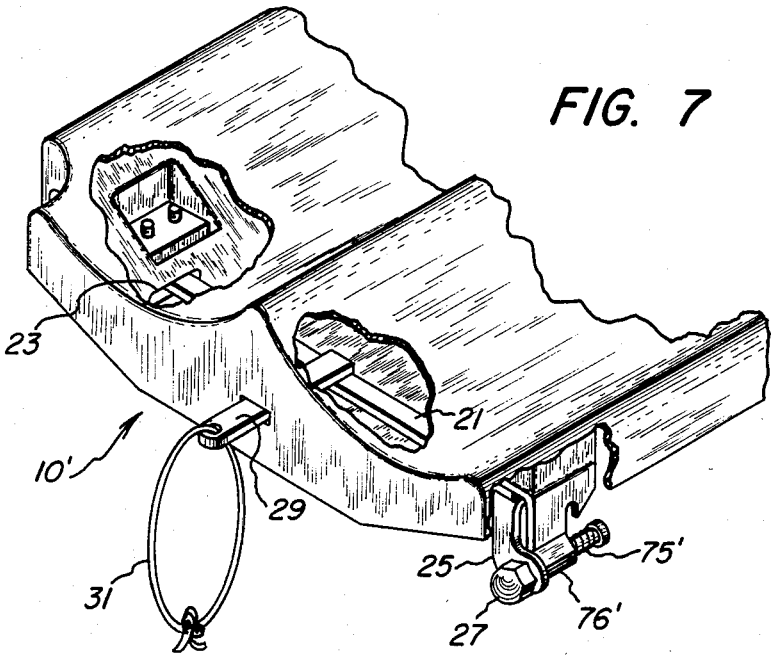
FIG. 7 is a fragmentary perspective view with parts broken away of a base showing an alternate mechanism for securing the base to a wheelchair.
Figure 8:
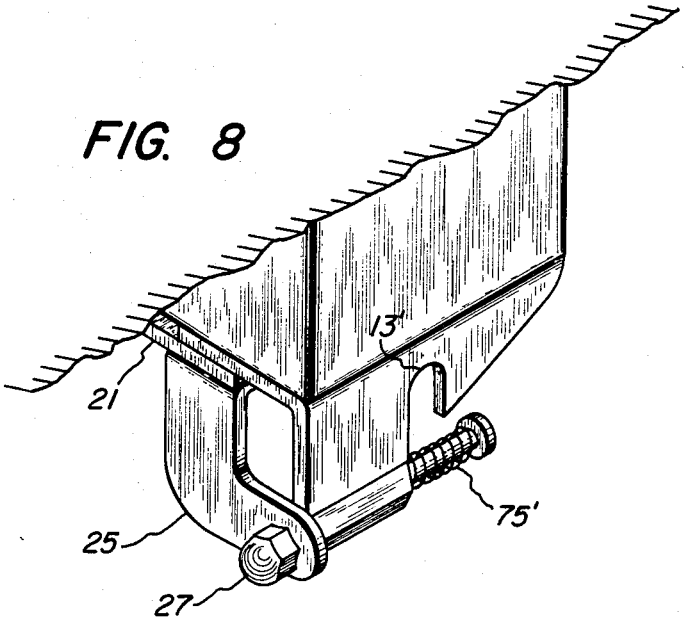
FIG. 8 is an enlarged view of a portion of FIG. 7.

FIGS. 7 and 8 show an alternate arrangement for securing the front portion of a base 10' to a wheelchair. Base 10' is equipped on either side with a pair of fixtures 76' containing spring biased locking plungers 75'. An operating.bar 21 is installed within base 10' so that its ends protrude through slots 23 in the proximity of fixtures 76'. A bracket 25 is shown to be attached to the right end of operating bar 21 and is also attached by means of acorn nut 27 to plunger 75'. A similar bracket is attached to the left end of bar 21 and its associated fixture 76'. An operating tongue 29 protrudes through a slot 33 in the front surface of base 10' and is equipped with a leather thong 31. To install or remove base 10' into or from a wheelchair, one simply draws operating tongue 29 forward, thereby operating plungers 75' and exposing grooves 13' for assembly with their associated studs 70 (see FIG. 5). This arrangement is particularly useful where the user has only one functioning hand. To remove base 10' from a wheelchair, he can insert that hand through thong 31 and simply pull forwardly and upwardly. By doing so, fixtures 76' will be unlocked from their associated studs and base 10' will then be lifted off the studs 70. The user is not likely to drop base 10', even if he is somewhat incapacitated, because thong 31 will remain around his wrist.

It is obvious that many modifications can be made to the invention described above without departing from its essential spirit and scope. The following claims are intended to encompass all such modifications.

What is claimed is:

1. A seat system for providing support for a seated occupant with a minimum of pressure on the occupant's seat bones so as to retard the formation of decubitous sores in tissue adjacent to those bones comprised of:

a rigid base having a pair of side edges and having a seating surface including a rearward section for receiving the occupant's buttock and a forward section for receiving the occupant's thighs;

the forward section having a pair of troughs between the side edges running forwardly from the rearward section and separated by a central ridge for supporting the thighs in an abducted position;

the rearward section having a pair of wings formed of sloped support surfaces running inwardly and downwardly toward one another from either side edge, said support surfaces terminating in an inner edge defining a void generally mushroomed in cross-sectional shape having a relatively wide laterally extending head portion located interiorly and centrally of the rearward section of the seating surface and a relatively narrow stem portion extending rearwardly and centrally from the head portion through said rearward section, the wings extending rearwardly of the forward section of the seating surface and each wing including an enlarged portion as its rearmost end in opposed relation to the other for providing support at the rearward end of the base to prevent rearward sliding of the occupant;

the rearward section also having a central support member for preventing forward sliding of the occupant, the central support member tapering forwardly and sloping upwardly from the head portion of the void to the central ridge of the forward section;

the wings, including their enlarged portions, and the central support member of the rearward section of the seating surface having the overall shape of a partial oval bowl surrounding the void with its longer axis running transversly of the base through the void and the troughs of the forward section of the seating surface flowing smoothly into the wings, whereby an occupant may be positioned on said base with his buttock in the rear section, his ischial bones over the head portion of the void, his coccyx over the stem portion of the void and his thighs in the troughs;

a deformable cushion having an overall peripheral shape similar to that of the seating surface of the base, including a pair of wings defining a void of the same general size and shape as that of the base; and means for securing the cushion to the base with the voids of each in approximate registration.

2. A base for a seat support system which provides support for a seated occupant with a minimum of pressure on the occupant's seat bones so as to retard the formation of decubitous sores in tissue adjacent ot those bones, said base having a pair of side edges and having a seating surface including a rearward section for receiving the occupant's buttock and a forward section for receiving the occupant's thighs;

the forward section having a pair of troughs between the side edges running forwardly from the rearward section and separated by a central ridge for supporting the thighs in an abducted position;

the rearward section having a pair of wings formed of sloped support surfaces running inwardly and downwardly toward one another from either side edge, said support surfaces terminating in an inner edge defining a void generally mushroomed in cross-sectional shape having a relatively wide laterally extending head portion located interiorly and centrally of the rearward section of the seating surface and a relatively narrow stem portion extending rearwardly and centrally from the head portion through said rearward section, the wings extending rearwardly of the forward section of the seating surface and each wing including an enlarged portion as its rearmost end in opposed relation to the other for providing support at the rearward end of the base to prevent rearward sliding of the occupant;

the rearward section also having a central support member for preventing forward sliding of the occupant, the central support member tapering forwardly and sloping upwardly from the head portion of the void to the central ridge of the forward section; and the wings, including their enlarged portions, and the central support member of the rearward section of the seating surface having the overall shape of a partial oval bowl surrounding the void with its longer axis running transversly of the base through the void and the troughs of the forward section of the seating surface flowing smoothly into the wings, whereby an occupant may be positioned on said base with his buttock in the rear section, his ischial bones over the head portion of the void, his coccyx over the stem portion of the void and his thighs in the troughs.

3. The invention of claim 1 wherein the securing means is such as to permit the cusion wings to be secured in a plurality of positions in which they are relatively closer to or more distant from one another.

4. The invention of claim 3 wherein the cushion is of the flotation type having one flotation cell located for registration with and being substantially coextensive with the rearward section of the base and one flotation cell located for registration with and being substantially coextensive with each trough of the base.

5. The invention of claim 2 in combination with means for mounting the base as the seat in a wheelchair.

6. The invention of claim 5 wherein the mounting means includes means for selectively securing the seat system in a plurality of positions relatively closer to or more distant from the backrest of the wheelchair.

7. The invention of claim 5 wherein the mounting means includes means for adjusting the height and tilt of the seat system in the wheelchair.

8. The invention of claim 5 in combination with a wheelchair.

9. The invention of claim 2 in combination with means for mounting the base as the seat in a wheelchair.

10. The invention of claim 9 wherein the mounting means includes means for selectively securing the seat system in a plurality of positions relatively closer to or more distant from the backrest of the wheelchair.

11. The invention of claim 9 wherein the mounting means includes means for adjusting the height and tilt of the seat system in the wheelchair.

12. The invention of claim 9 in combination with a wheelchair.

13. A cushion for use in a seat support system having a rigid base, said seat support system providing support for a seated occupant with a minimum of pressure on the occupant's seat bones so as to retard the formation of decubitous sores in tissue adjacent to those bones, said cushion having a forward section and a rearward section, said rearward section including a pair of wings extending rearwardly from the forward section in a space apart relationship to one another and each wing terminating in an enlarged portion positioned in opposed relation to the other, said wings defining a void generally mushroomed in cross-sectional shape having a relatively wide laterally extending head portion interiorly and centrally of the rearward section of the cushion and a relatively narrow stem portion extending rearwardly and centrally from the head portion through the rearward section, and said wings having securing means attached to their underside which allow said wings to be secured to said rigid base in a plurality of positions so that the particular dimensions of the mushroom-shaped void may be adjusted to each occupant's anatomy, whereby an occupant may be positioned on said cushion with his buttocks in the rear section, his ischial bones over the head portion of the void, his coccyx over the stem portion of the void and his thighs in the forward section.

14. The invention of claim 12 wherein the cushion is of the flotation type having one flotation cell substantially coextensive with the rearward section and a pair of flotation cells in the forward section, separated by a central divider running through the forward section to the rearward section.

* * * * *

UNITED STATES PATENT AND TRADEMARK OFFICE

CERTIFICATE OF CORRECTION

PATENT NO. : 4,643,481

DATED : February 17, 1987

INVENTOR(S) : William S. Saloff, David Saloff

It is certified that error appears in the above-identified patent and that said Letters Patent is hereby corrected as shown below:

Column 9, line 33, the claim reference numeral "2", should read --1--, Column 10, line 38, the claim reference numeral "12", should read --13--.

Signed and Sealed this

Eighth Day of September, 1987

*Attest:*

DONALD J. QUIGG

*Attesting Officer*

*Commissioner of Patents and Trademarks*